United States Patent [19]

Turner

[11] Patent Number: 4,831,959

[45] Date of Patent: May 23, 1989

[54] BLENDER FOR APPLYING FINELY DISPERSED LIQUID DROPLETS OF RESINS AND/OR WAXES ON SURFACES OF PARTICULATE WOOD MATERIALS

[76] Inventor: Harold D. Turner, P.O. Box 726, Puyallup, Wash. 98371

[21] Appl. No.: 508,004

[22] Filed: Jun. 27, 1983

Related U.S. Application Data

[63] Continuation of Ser. No. 208,307, Nov. 19, 1980, abandoned.

[51] Int. Cl.[4] ..... B05C 5/00

[52] U.S. Cl. ..... 118/303; 427/221

[58] Field of Search ..... 118/19, 303; 427/212, 427/221; 366/173, 155, 169, 170, 235

[56] References Cited

U.S. PATENT DOCUMENTS

| | | | |
|---|---|---|---|
| 2,808,343 | 10/1957 | Simmons | 118/632 X |
| 2,915,300 | 12/1959 | Fischer | 366/170 |
| 2,953,359 | 9/1960 | Mau | 118/303 X |
| 2,986,338 | 5/1961 | Foster | 239/222 |
| 3,016,875 | 1/1962 | Ballentine, Jr. et al. | 118/318 X |
| 3,101,040 | 8/1963 | Lanz | 118/19 X |
| 3,408,980 | 11/1968 | Benson | 118/19 |
| 3,974,307 | 8/1976 | Bowen | 118/418 X |
| 4,118,524 | 10/1978 | Seaman | 427/213 |
| 4,193,700 | 3/1980 | Wirz | 118/418 X |
| 4,237,814 | 12/1980 | Ormos et al. | 118/24 |
| 4,274,360 | 6/1981 | Hofmann et al. | 118/303 |
| 4,430,003 | 2/1984 | Beattie et al. | 118/303 X |

FOREIGN PATENT DOCUMENTS

| | | | |
|---|---|---|---|
| 2445375 | 4/1976 | Fed. Rep. of Germany | 118/303 |

*Primary Examiner*—Shrive Beck

*Attorney, Agent, or Firm*—Roy E. Mattern, Jr.

[57] ABSTRACT

To uniformly and economically disperse liquids, via sprays of droplets, on surfaces of particles a method of moving the particles involves their rotary lifting, followed by their free falling, with a spray of droplets originating from a central area of the overall motion path of the particles. In a preferred embodiment of the method and a preferred embodiment of the blending apparatus, a hollow drum is rotated about a near horizontal axis. Inside the drum on a common rotating shaft spaced slightly conical discs ultimately disperse respective sprays of droplets from a central area. This central area is defined by particles being lifted while centrifugally held to the interior of the drum and then at a zenith locale the gravitational force becomes effective enough so the particles drop in an arcuate cascade path back to the interior surface of the drum to start another cycle. The cycles are predetermined to continue until the particles acquire the selective quantity of dispersed droplets on all of their surfaces. Then the particles leave the interior of the rotating hollow drum opposite the end of their entry into the drum. This method and apparatus is particularly useful in treating, with liquid resin binders, and/or wax emulsions, thin wood wafers, wood flakes, wood shavings, sawdust and other particles of like respective sizes, which often are subsequently collectively formed and pressed into products, such as wood wafer boards.

18 Claims, 7 Drawing Sheets

BLENDER FOR APPLYING FINELY DISPERSED LIQUID DROPLETS OF RESINS AND/OR WAXES ON SURFACES OF PARTICULATE WOOD MATERIALS

CROSS REFERENCE

This application is a continuation application being a copy of copending application Ser. No. 208,307 of the same title and the same Applicant, i.e. Harold Dale Turner

ANOTHER APPLICATION OF RELATED SUBJECT MATTER

There is information common to this application also to be found in copending application Ser. No. 207,964 filed Nov. 18, 1980, now U.S. Pat. No. 4,430,003, originally entitled differently, and now, via amendment, entitled Apparatus for Spraying Liquids Such as Resins and Waxes on Surfaces of Particles.

BACKGROUND OF THE INVENTION

Throughout industry there is often the requirement to efficiently and economically disperse liquids on the surfaces of particles which should not undergo mechanical damage or abrasion. Moreover, many of these particles are collectively crowded together to form a composite product. The integral strength success of the composite product, where for example the liquids are binders, is based on the uniform or near uniform dispersement of the liquid throughout all the surface areas of the particles.

These factors are especially true when wood products are being manufactured. However, present methods and available apparatus do not completely fulfill all of the currently desired economic, quality and efficiency objectives.

In this regard in respect to the wood wafer board industry dispersement of resin binders is now undertaken in blenders, wherein finely pulverized dry resin is applied to wood wafers via tumbling within an inclined rotating drum. The dry resin, so pulverized, is obtained at a higher cost than liquid resins. In the particle board industry wood chips are sprayed with liquid resins while the wood chips undergo intense agitation. The liquid resin is sprayed into the turbulent mass of wood chips via air atomization or via fluid pressure nozzles. These wood chip blenders have nozzles which produce droplets in an unwanted wide dispersion of droplet sizes. Their air driven atomization sprays tend to carry the finest droplets of resin out in air venting streams, thus creating a nuisance while wasting resin. Moreover, in these wood chip blenders, the intense agitation produces heat and creates more fine material from the particles, that in turn, tends to absorb a disproportionate fraction of the consumed resin. In addition, resin-particle agglomerates tend to build up on the walls and paddles of these blenders requiring frequent costly cleaning maintenance.

In respect to information presented in U.S. patents, W. Wirz in his U.S Pat. No. 4,193,700 of Mar. 18, 1980 disclosed a short length drum, with internal vanes of lifters, rotated to yield an intermittent cascade of particles, while a spray nozzle dispersed a binder in an axial direction, from the feed end of the drum into the particle cascade. Also K. Engels in his U.S. Pat. No. 4,188,130 of Feb. 12, 1980 illustrated and described a drum with internal lifters to rotary lift particles for their subsequent cascading, while at the feed end of the drum, nozzles axially sprayed liquid resin toward the particles. Although Messrs. Wirz and Engels' apparatus comparatively gently handled the particles, the reliance on axially directed sprays required a high droplet concentration of liquid resin to achieve a reasonable output rate of treated particles. Such high concentration of resin droplets tends to yield a wide range in droplet size and reduces the opportunity for uniform coverage of the particles. Moreover, because one third to two thirds of their interior drum surfaces and lifters are also exposed to the spray of resin, there is the wasteful accumulation of resin on these exposed interior surfaces, also incurring cleaning maintenance costs.

Improved dispersement of liquid resins is also needed in the emerging structural board manufacturing processes, wherein carefully sliced wood wafers and flakes are used. To attain maximum panel strengths of these structural boards the sliced wood wafers and flakes should remain undamaged in blending operations and thereafter they should be aligned, as described by H. D. Turner in an article entitled "Structural Flakeboard Stiffness—Relation to Deflection Criteria and Economic Performance", as published in *Forest Products Journal* Volume 27, Number 12, December 1977.

In respect to all such related uses of resins, the distribution of the resins must be very efficient. Resin, at five percent of the dry wood weight, has a resin cost which is about one half of the wood cost. Usually the resin cost is the second largest cost element in wood board manufacturing.

Therefore, gentle handling of flakes and maximum efficiency of the resin distribution with minimum losses of resin are both important objectives in operating wood board processes, and especially in operating structural board processes wherein the wood wafers and wood flakes are aligned.

SUMMARY OF INVENTION

A new blending method and new blending apparatus are provided to more efficiently utilize liquids such as resin binders and wax emulsions, particularly in the wood products industry, by creating controllable sprays of droplets having a high proportion of uniform sized droplets leaving the edges of spinning discs. The particles are moved via a gentle action and in reference to wood wafers, wood flakes, there is minimal damage or change to these particles. There are no high speed agitation forces or high pressure agitation forces involved. Moreover, blender maintenance is very minimal in respect to misdirected sprays of liquids and the accumulation of fines, both of which would otherwise cause plugging or jamming of a blender. This is true for the spray is essentially always intercepted by the particles, which shield the interior walls of the blender. By using the new blending method and apparatus, it is estimated the liquid savings, i.e. resin binder savings, etc., will range from three thousand to five thousand dollars a day, at 1980 price levels, during the operation of a typical three hundred ton per day capacity plant, i.e. a wafer board mill.

In respect to the method, the uniform and economical dispersement of the liquids, via sprays of droplets, on surfaces of particles is undertaken by moving the particles via rotary lifting, followed by their free falling, with a spray of droplets originating from a central void area between the overall motion path of the particules.

In a preferred dembodiment of the blending apparatus, a hollow drum is rotated about a near horizontal axis. Inside the drum, mounted on a common hollow rotating shaft, are spaced slightly conical discs, which ultimately disperse respective sprays of droplets from a void central area. This void central area is determined or defined by the particles being lifted, while centrifugally held to the interior of the drum and then at the zenith locale near the top of the drum interior, the gravitational force becomes effective enought so the particles drop in an arcuate cascase path back down to the interior surface of the drum to start another cycle. These cycles of lifting and cascading are predetermined in number to continue until the particles acquire the selective and sufficient quantity of dispersed droplets on all their surfaces. Then the treated particles leave the interior of the rotating hollow drum at the exit end, opposite the end of their entry into the drum. This method and apparatus is particularly useful in treating, with liquid binders and/or wax emulsions, thin wood wafers, wood flakes, wood shavings, sawdust, and other particles of like respective sizes, which often are subsequently collectively formed and pressed into products such as wood wafer boards and structural boards.

DESCRIPTION OF DRAWINGS

A preferred embodiment and other embodiments of the blending apparatus are illustrated in the drawings supplemented by illustrative manufacturing facility schematic flow charts, and graphs concerning the working range of droplet size and travel, wherein.

DESCRIPTION OF THE INVENTION

One Environment of Where the Blending Method and Blender are Utilized

Figure 1:
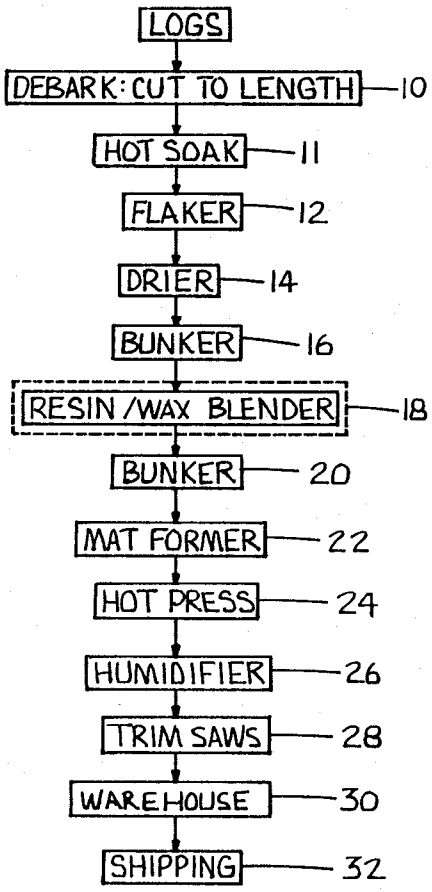
FIG. 1 is a schematic flow chart of a composite wood product manufacturing facility indicating where the blending apparatus and method are utilized with respect to the order of the overall apparatus and method.

The preferred embodiment of this invention is described in reference to its utilization in a manufacturing process wherein wood particles are formed and pressed into wood products. In FIG. 1 the overall method steps and related apparatus of such a manufacturing process are illustrated in chart form. Logs are debarked and cut to length 10; hot soaked 11; flakes or other particles are made 12; they are dried 14; and as necessary the dried flakes are stored in a bunker 16, for subsequent processing. These inventions, i.e. both a blending method and a blender 18, are used in the next step of the overall process, wherein the particles are efficiently, economically, and uniformly treated in the blender being sprayed with droplets of resin binder and/or wax emulsions. The treated particles are, if necessary, stored in a bunker 20; then formed 22 in a mat; hot pressed 24; adjusted for moisture content in a humifier 26; trimmed by saws 28; stored, as necessary in a warehouse 30; and shipped 32 upon an order of a customer.

Preferred Liquid Droplets Sizes and Their Travel in Reference to Their Creation and to Their Dispersion, Reference to a Disc Spraying Theory In the practice of this method and the arrangement and operation of the apparatus, the creation of the liquid droplets in all respects, and especially in reference to their sizes and travel, is very important. Also, as discussed subsequently, the movement of the particles to receive the dispersed droplets is likewise very important.

In reference to a disc spraying theory, the production of sprays and mists by means of spinning discs, is believed to have been first investigated experimentally and theoretically by Messrs. Walton and Prewett and later in more detail by Mr. Drummond. These earlier experiments may have pertained to spinning discs used commercially to spray insecticides and paints; however the observations are deemed pertinent to understanding why and how rotating, i.e. spinning, discs are used in the method and blender of this invention.

The formation of drops leaving from the edge of a spinning disc is analogous in many ways to drop formation leaving from a stationary tip. Liquid flows to the edge of the disc and accumulates until the centrifugal force on the collected mass is greater than the retaining forces due to surface tension, and then the drop is thrown off.

Thus, it is reasonable to expect the product of the surface tension and linear dimension of the drop to be proportional to the centrifugal force.

In symbols:

$$(\pi d^3P)/(6)\ (w^2D)/(2)\alpha Td$$

or rearranging $$dw(Dp)^{\frac{1}{2}}/(T)=\text{constant}$$

where d=drop diameter
T=liquid surface tension
p=liquid specific gravity
D=disc diameter
w=disc angular velocity Extensive experiments by Messrs. Walton and Prewett resulted in an average value for the constant of 3.8, with a range of 2.67 to 6.55. Their experiments also showed, the sharpness or edge profile of the disc was of minor importance. In the range of viscosity investigated, 0.01 to 15 poise, viscosity had little effect on the spraying process, although high viscosity did tend to reduce the maximum flow rate at which homogeneous drops are formed. At small drop sizes, the drops or droplets become airborne, forming a mist.

Mr. Drummond presented his experimental results showing the effects of flow rate Q, kinematic viscosity u, and spin rate w, on the drop size d and rate of drop production. Drop volume is shown to exceed the volume predicted by Messrs. Walton and Prewetts' static model, indicating that the dynamics of drop formation must be included in the model.

In the course of perfecting this invention a number of experiments were conducted in which a paper tape was exposed to the spray pattern for a short interval, thus recording the droplet size distribution and spray pattern. Both water and high viscosity liquid phenol formaldehyde resin were used. Utilizing equation, and the following parameters: D=250 mm, w=534 radians/-second, T=7.3 dyne/mm, and p=1.1, the theoretical drop size was predicted at 0.12 mm as compared to experimental values of 0.20 to 0.30 mm. This agreement was considered satisfactory, and it was noted the drops inevitably tend to spread out, rather than retain their spherical shape upon reaching a surface of a particle to be treated.

Figure 2:
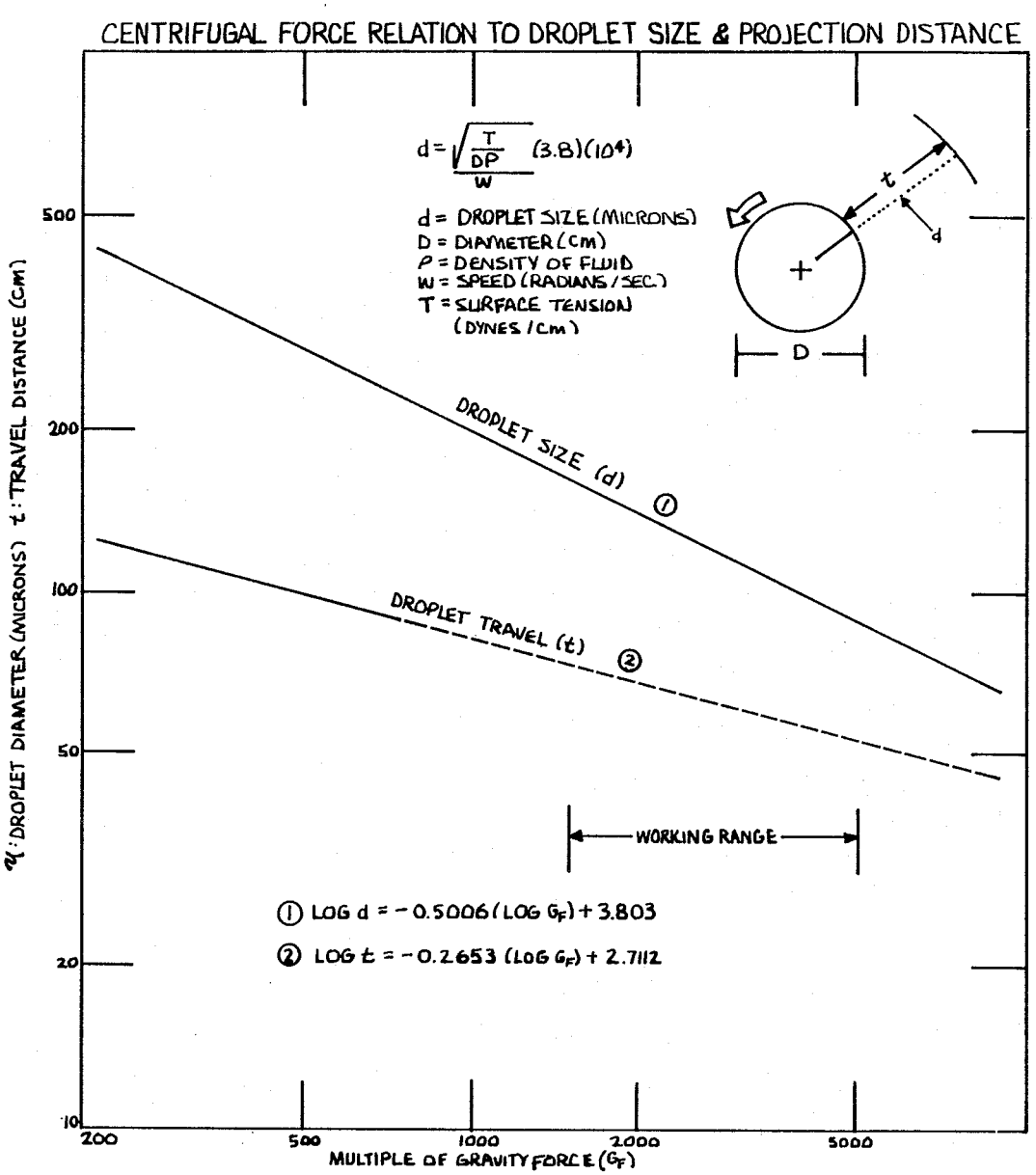
FIG. 2 is a graph illustrating the desirable working range in respect to the size and travel of the droplets of the liquids, such as resin binders and wax emulsions.

In FIG. 2, the liquid droplet size and travel are illustrated in a graph to indicate the working range selected in reference to the method and operation of the blender of this invention. The droplet size graph line has a y ordinate regarding size expressed in microns and an x ordinate regarding centrifugal force expressed in multiples of the gravitational force. The droplet size graph line has a y ordinate regarding distance to travel in centimeters and an x ordinate regarding centrifugal force expressed in multiples of the gravitational force. The droplet size range is from approximately 200 to 50 microns and the droplet travel range is from about 90 cm to 20 cm depending on liquid properties and gravity force multiples at the spray disc rim. Thus, volume per drop may range from $4200\times10^3$ cubic microns to $65\times10^3$ cubic microns, i.e. a 64 fold range in drop size.

Figure 3:
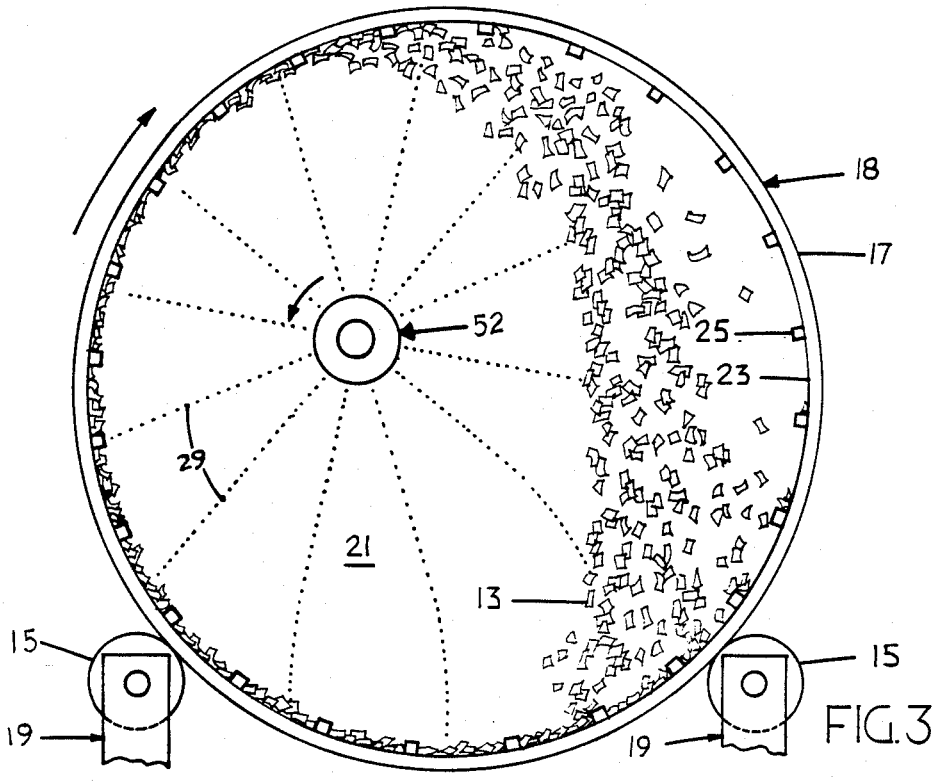
FIGS. 3 and 4 are cross sectional views illustrating the method and apparatus with respect to the rotary lifting of the particles, followed by their free falling in an arcuate cascade, with a spray of droplets originating from a central void area between the overall motion path of the particles, also showing different interior surface configurations of the drums to facilitate uniform lifting and mixings.
Figure 4:
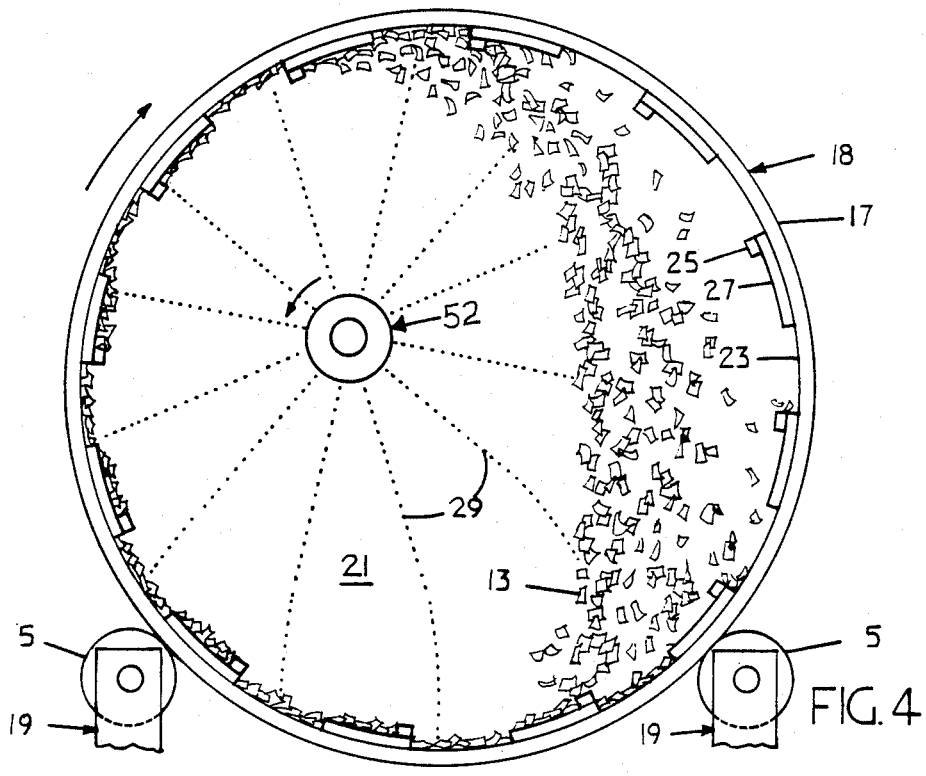

The Controlled Movement of Particles as They are Being Treated With the Sprayed Liquids, Commencing with Rotary Lifting and Then at a Zenith Locale Free Falling an an Arcuate Cascade, With the Spray Coming From Spinning Discs Located in the Central Void Area Between the Overall Movement Path of the Particles In FIGS. 3 and 4, the controlled movement of particles 13 is illustrated as viewed in a transverse section taken through a rotating drum 17 of a blender 18. The drum 17 rotates in a clockwise rotational direction on bearings 15 mounted on an adjustable frame 19, shown in part. In a central void area 21 or volume of the interior of the drum 17 there are spaced rotating, i.e. spinning, discs 52 which create the spray of droplets of liquids such as resin binders or wax emulsions. The interior walls 23 of the drum 17 are coated with a plastic finish so the particles 13 will not adhere to those interior wall surfaces. Also eventually when cleaning becomes necessary, the plastic covered walls are readily cleaned. Therefore, as viewed in FIGS. 3 and 4, longitudinal ribs 25 or raised portions 27, i.e. lands and grooves are utilized in assisting in the rotary lifting of the particles 13 to compensate when necessary for the effects of the plastic finish. The alternate raised lands and grooves 27 and 23 respectively insure the radial intermixing of the particles as they traverse the blender.

As illustrated in both FIGS. 3 and 4, the particles 13 are rotary lifted while positioned adjacent to the interior wall 23 of the drum, until gravitational forces becomes effective in causing the particles 13 to freely fall in an arcuate cascade until reaching again the interior wall 23 to begin another cycle. Each respective spinning disc is located, in reference to a particular transverse cross sectional view, within the central void area defined by the overall movement of the collective particles 13. As observed in FIGS. 3 and 4 the sprayed droplets 29 reach the particles without any appreciable amount of them escaping on through to unwantedly contact the interior wall 23 of the blender 18.

The Additional Controlled Movement of the Particles Under Treatment to Move Them on Through the Blender While Being Sprayed With Liquids and Reference to Speed Changes at the Circumferences of the Interior of the Drum.

Figure 5:
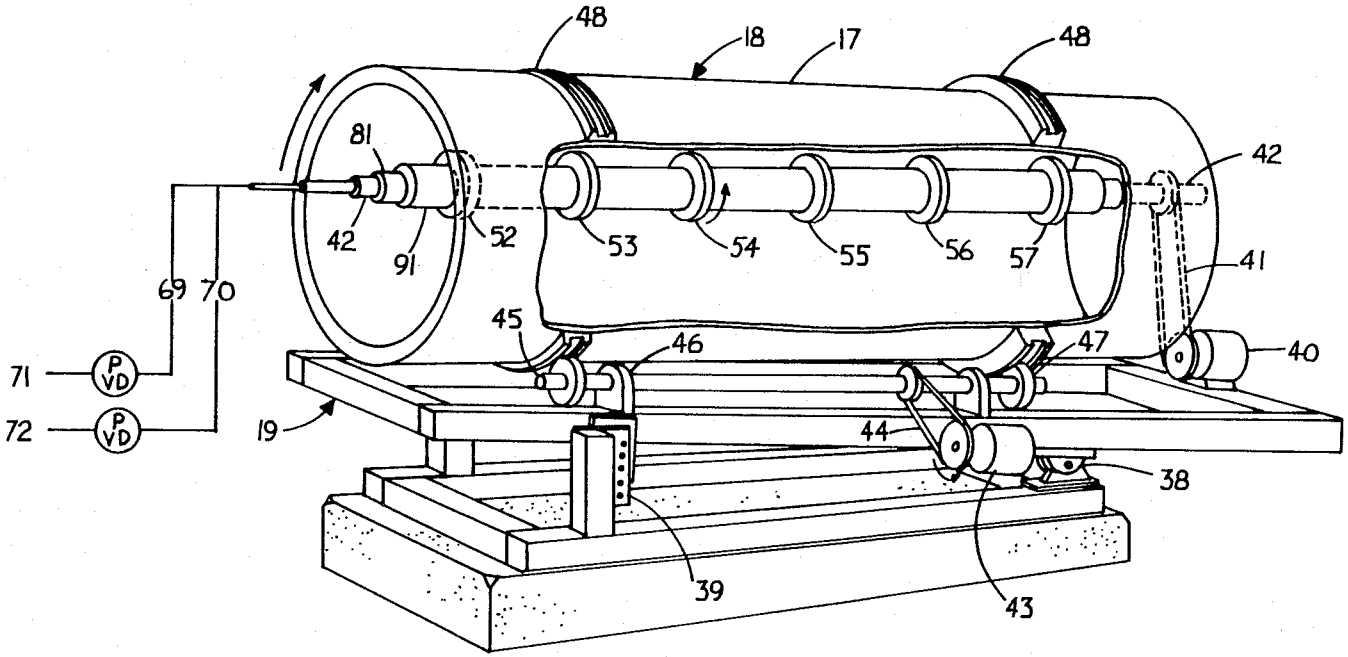
FIG. 5 is an isometric view of a preferred embodiment of the blending apparatus, i.e., the blender, with portions removed for illustrating the interior of the drum, and the arrangement on the hollow shaft and the multiple discs.
Figure 6:
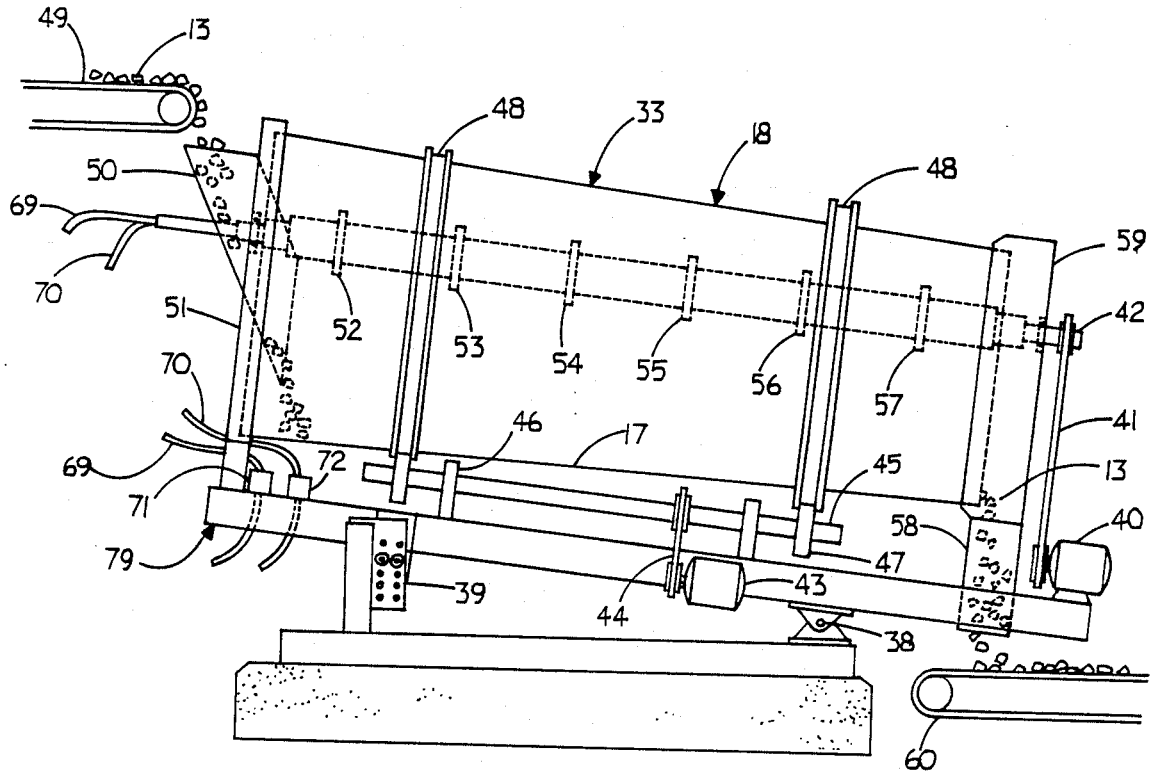
FIG. 6 is a side view of another embodiment of the blender illustrating a tapered drum and also showing the entry and exit for the particles.
Figure 7:
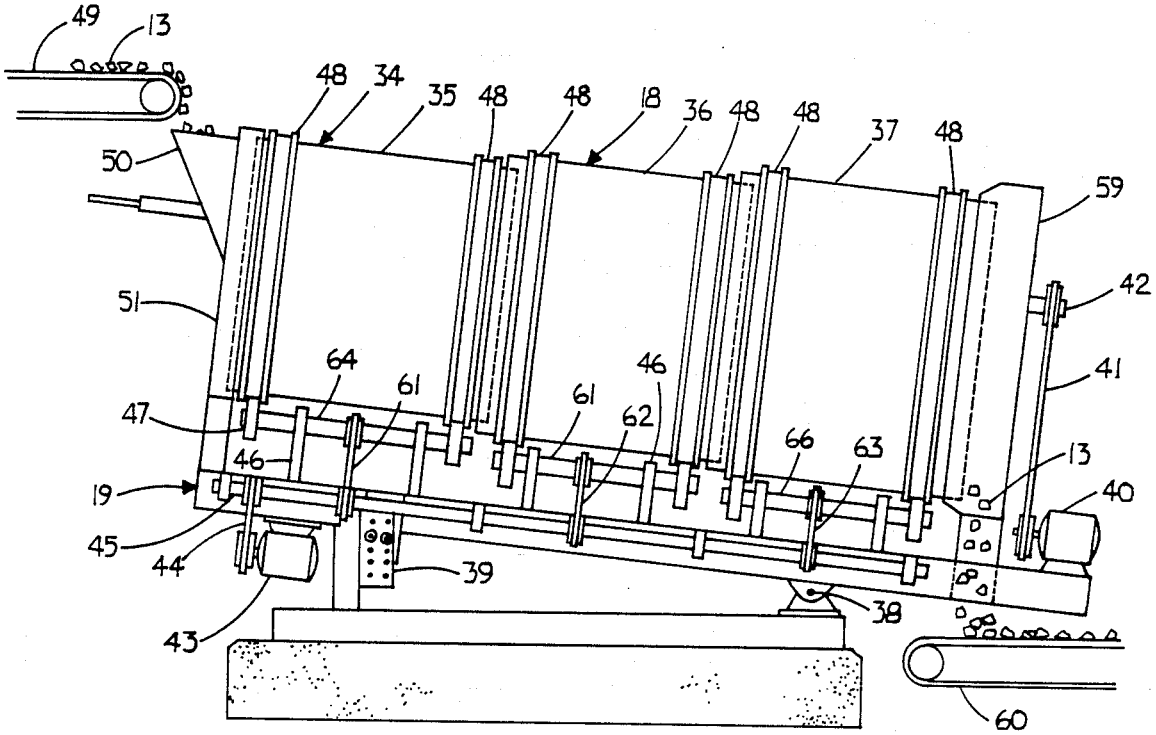
FIG. 7 is a side view of another embodiment of the blender illustrating a three section drum, with each section being of a different diameter and having a respective drive assembly operating at a different rotating speed, and also showing the entry and exit for the particles.

In FIGS. 5, 6, and 7, the longitudinal observations indicate the drum 17 of the blender 18, in various embodiments, always rotates about a near horizontal axis, with the entry end receiving the particles 13 being higher than the exit end discharging the particles 13. The retention time of the particles 13 in the blender 18 is controllable by adjusting the angle of inclination of the blender in respect to its near horizontal axis. Generally depending on the inclination angle the particles make from twenty to forty revolutions while being treated in the blender 18. For example in a ten foot diameter blender twenty feet long with a one minute retention time, when the drum 17 is rotating at twenty five revolutions per minute, requires an inclination angle of about four and one half degrees.

In reference to the rotational speed of the drum 17 of a blender 18, for example, to achieve the most desirable cascading free falling action of the particles 13. Therefore, in reference to the entire length of a drum 17, and realizing as the particles progress from the entry to the exit, they gain in their receipt of resin binder, the peripheral or circumferential speed is automatically reduced by utilizing a tapered drum 33 as illustrated in FIG. 6. Or a sectional drum 34 is used as shown in FIG. 7 for a multi-stage operation with the telescoping sections 35, 36, 37 being operated at different rotational speeds so their respective peripheral or circumferential speeds may be reduced as necessary.

The Arrangement of the Components of the Blender as Illustrated in FIG. 5

The blender 18 illustrated in FIG. 5, has a drum 17 of constant outside diameter. As necessary the interior diameter changed by the addition of properly sized liners, not shown, to accommodate the possible need for a reduction in the peripheral speed, i.e. speed at the circumference of the interior. The overall supporting frame 19 is adjustable to change the retention time of the particles 13 within the drum 17. At the exit end there is a pivotal frame mounting 38 and at the forward end there is a level changing frame mounting 39. Such angular adjustment of frame 19 likewise adjusts the entire components of the blender 18 through the small angle of inclination.

A motor 40, via a power transmission belt rotates shaft 42. Spray discs 52, 53, 54, 55, 56, and 57 are mounted at spaced intervals along large diameter tubular shaft 42 and their spinning speed is controlled by operating motor 40.

An adjustable speed motor 43, via a power transmission belt or change 44, drives a line shaft 45 mounted on bearings 46 secured to frame 19. Near the ends of shaft 45 are frictional drive wheels 47 which rotate within circumferential track channels or rails 48 secured around the drum 17, thereby rotating the drum 17 in a clockwise direction, as indicated by the motion arrow in FIG. 5.

The Arrangement of the Components of the Blender as Illustrated in in FIG. 6, and the Entry and Exit of the Particles The blender 18 illustrated in FIG. 6, has a tapered drum 33 which serves to automatically reduce the peripheral speed, i.e. speed at the circumference of the interior, to compensate for the particles nearing the exit which have changed in dynamic behavior in respect to their adhering resin binder droplets 29. The angular adjustments of the horizontal inclination of the drum 33 are similar to those indicated in FIG. 5. Also thepower transmissions respectively to both the shaft 42 and the tapered drum 33 are similar to those described in regard to the blender 17 shown in FIG. 5. As is also true, but not shown in FIG. 5, the particles 13 are illustrated in FIG. 6, being delivered via a loading conveyor 49 and directed into a loading chute 50 secured to the non rotating entry end enclosure 51. After passage through their various advancing cycles within the drum 17, the particles 13 with their accumulated resin binder leave the drum 33 via the exit chute 58 positioned by the non rotating exit end enclosure 59 and then they drop onto the discharge conveyor 60.

The Arrrangement of the Components of the Blender as Illustrated in FIG. 7 and the Entry and Exit of the Particles The blender 18 illustrated in FIG. 7, has a sectional drum 34 having three sections 35, 36, and 37 increasing in diameter and telescoping. Many of the components are similar to those illustrated in FIGS. 5 and 6 and are indicated by like numerals. Each section 35, 36 and 37 is driven at a different speed so the peripheral speed, i.e. speed at the circumference of the respective three different diameter interiors may be independently controlled decreasing in speed from the entry to the exit of the sectional drum. This speed reduction is undertaken to accommodate the particles receiving the resin binder which at the slower speeds will then commence their free fall in the cascade at the proper zenith locale on the respective interiors of the drum sections 35, 36 and 37. The power being distributed by the line shaft 45 is distributed via three transmission belt or chain assemblies 61, 62, 63 to respective secondary power distribution shafts 64, 65, 66 at the respective drum sections 35, 36, and 37. The drive wheels 47 follow channels or rails 48.

Figure 8:
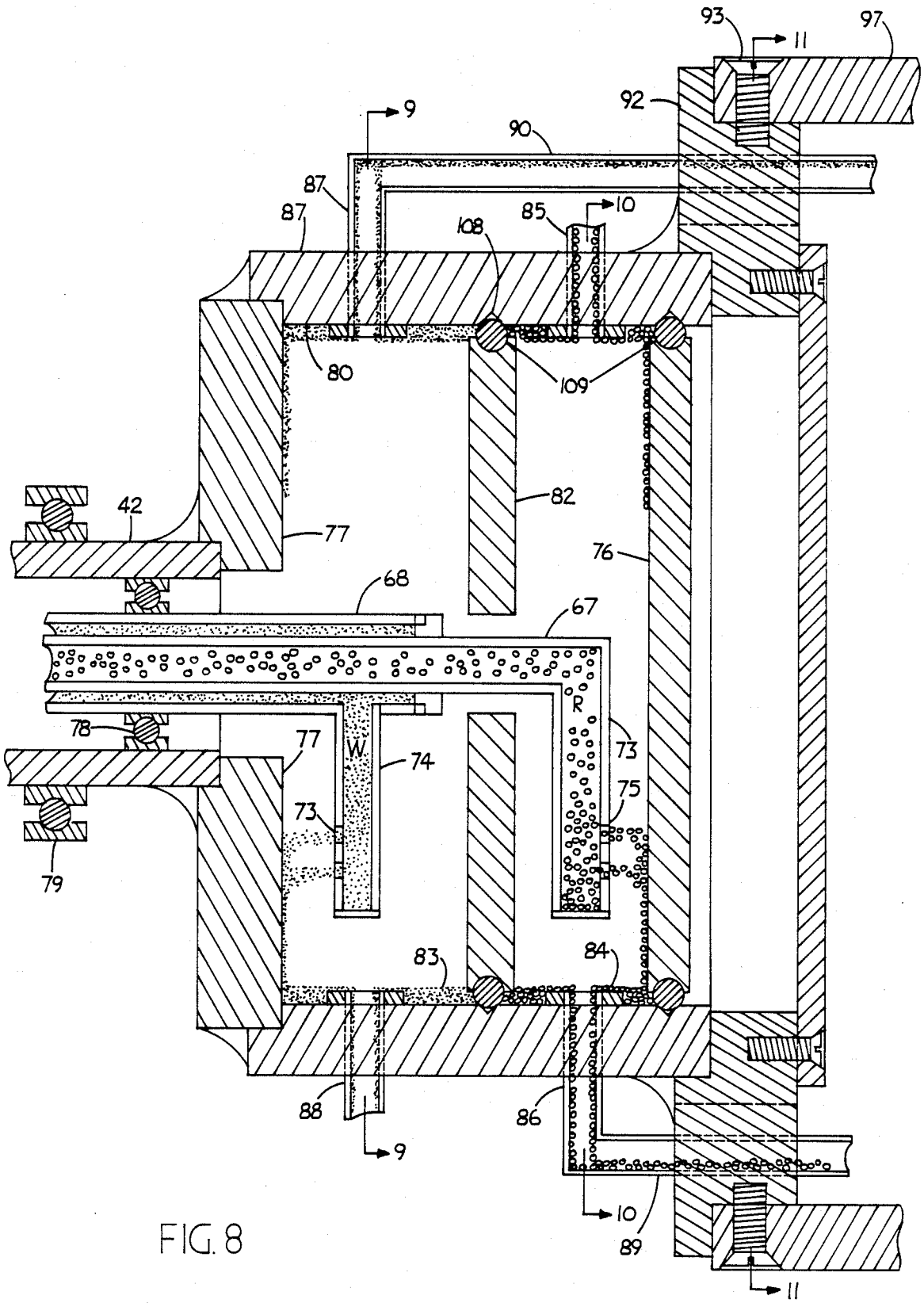
FIG. 8 is a longitudinal cross sectional view near the entry end of the blender showing the liquid distribution supply system attached to the end of the large diameter hollow shaft that carries the spray discs.
Figure 9:
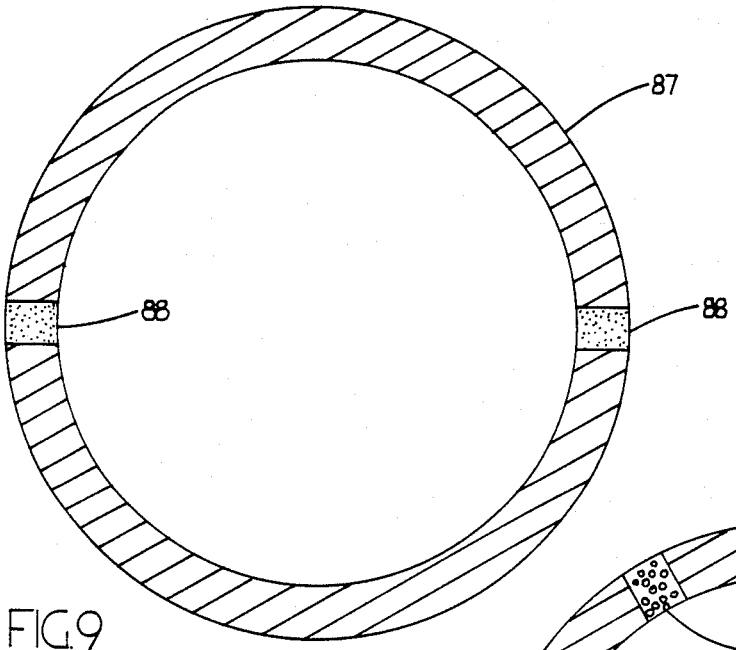
FIG. 9 is a partial transverse cross sectional view showing the starting distribution of the wax emulsion, with this view being taken along line 9—9 of FIG. 8.
Figure 10:
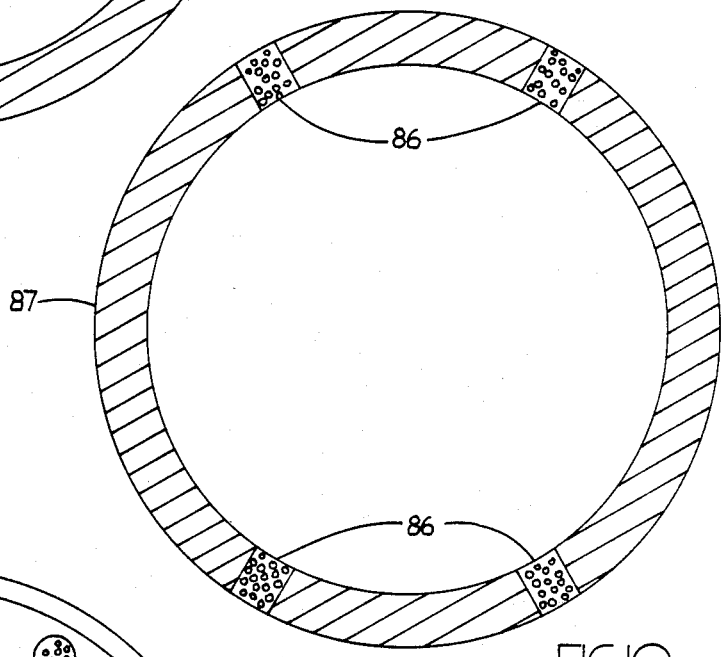
FIG. 10 is a partial transverse cross sectional view showing the starting distribution of the resin binder, with this view being taken along line 10—10 of FIG. 8.
Figure 11:
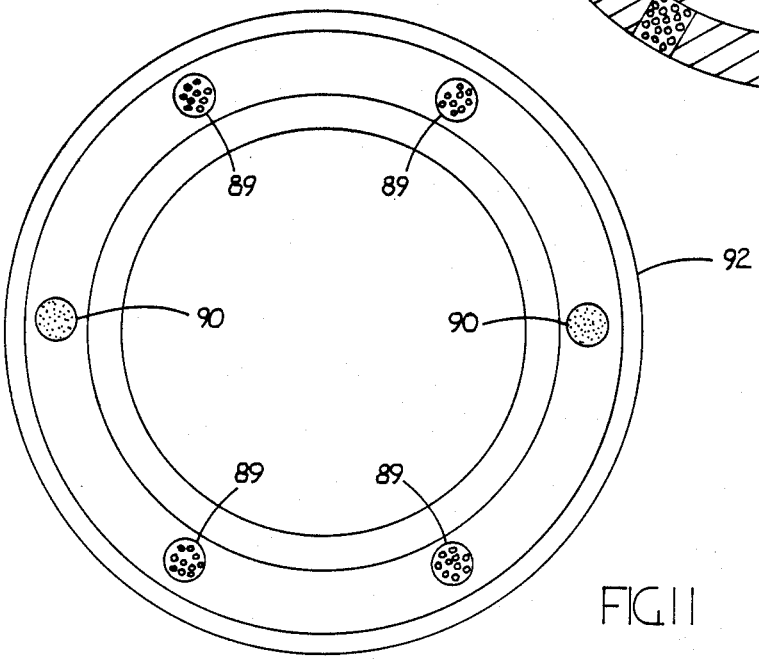
FIG. 11 is a partial transverse cross sectional view showing the starting distribution of both the resin binder and wax emulsion with this view being taken along line 11—11 of FIG. 8.

The Distribution and Supply of the Liquids, for Example, the Resin Binders and Wax Emulsions, to the Spinning or Rotating Dics Which Create the Spray of Droplets In FIGS. 6, 8, 9, 10, 11, and 12, the distribution and supply of the liquids, i.e. resin binder R and wax emulsion W, to the spinning discs, such as disc 52, are illustrated. As shown in FIGS. 6 and 8, concentric stationary supply tubes 67 and 68, respectively receive the resin binder R and the wax emulsion W, received through hoses 69 and 70 being fed by pumps 71 and 72 from conventional supply sources of each which are not shown. Thereafter the resin binder R and the wax emulsion W, after directional changes shown in FIG. 8 leave the stationary supply tubes 67 and 68. These liquids leave through downward pointing stub tubes 73, 74, which have exit holes 75 directed to nearby plates 76 and 77 which are rotating rapidly with the shaft 42.

Bearing 78 is used in positioning the stationary supply tubes 67 and 68 relative to these portions, inclusive of plates 76 and 77, which are totating with the shaft 42. Bearing 79 is used to position the rotating shaft relative to the frame 19 of the blender 18.

The resin binder R and the wax emulsion W, respectively upon leaving exit holes 75 travel through space until reaching plates 76 and 77. Thereafter centrifugal force moves the liquids radially outwardly to the inner wall 80 of a cylindrical section 81. Plate 82, installed with the aid of grooves 108 and sealing rings 109 similarly to the installation of plate 76 serves to keep the resin binder R and wax emulsion W separated throughout the operations as these liquids form the respective rotating shallow toroidal pools 83, 84. Continuously during operations, the liquids depart from these supply pools 83, 84 and enter respective distribution tubes 85, 86, 87, 88, 89, and 90, which longitudinally distribute the resin blender R and wax emulsion W to spinning dics 52, 53, and 54 being supplied from the entry end of the blender 18. Spinning discs 55, 56 and 57 are supplied in like manner from the exit end of the blender 18. These distribution tubes are located within the protective longitudinal cylindrical shaft 91 secured by fasteners 93, after being positioned in plate 92 which also sealed off the liquids from the interiors of the shaft associated components such as tubular shaft 91. The cross sectional views of FIGS. 9, 10, and 11 further illustrate the distribution of liquids R and W.

Figure 12:
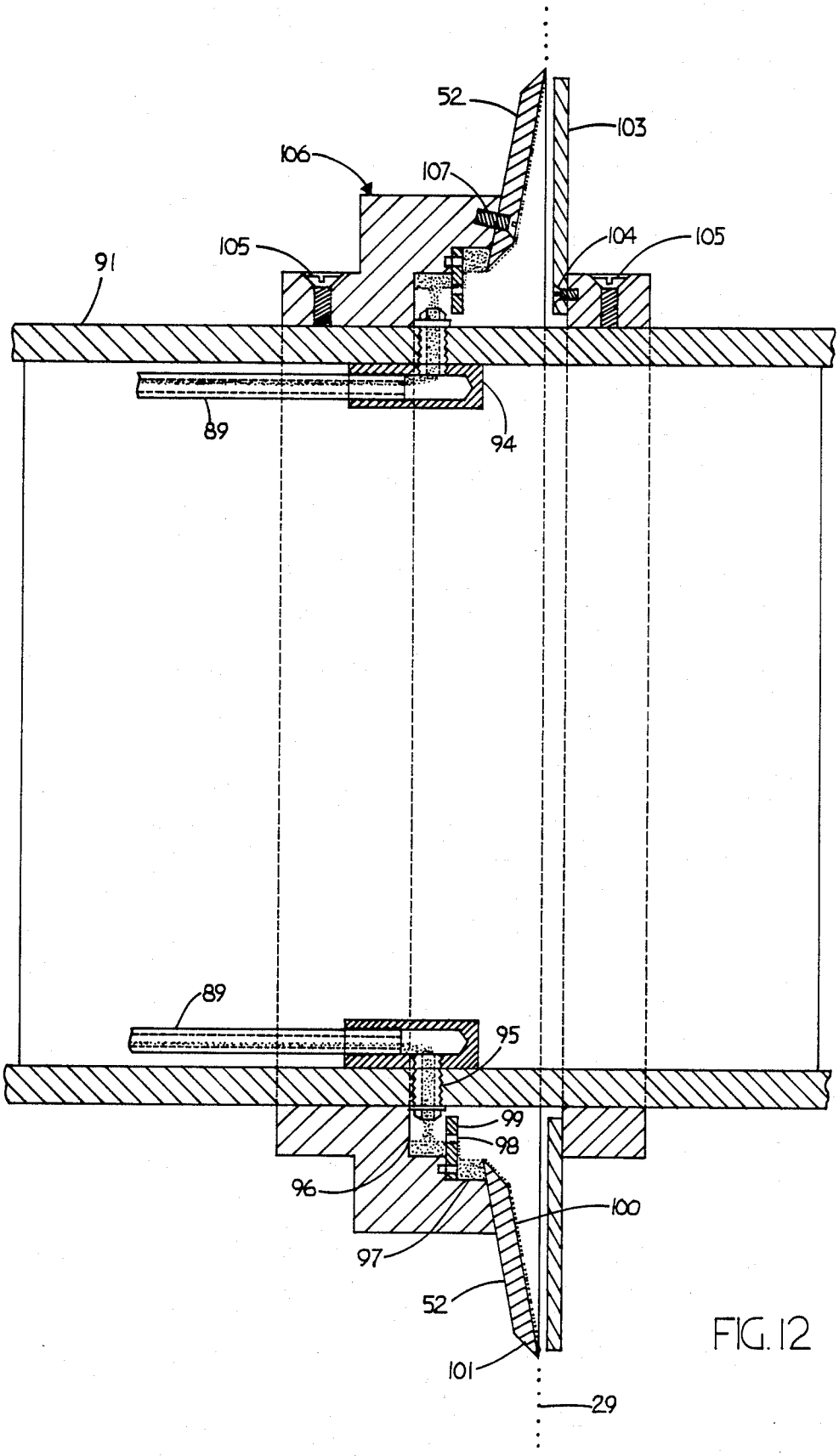
FIG. 12 is a partial longitudinal cross sectional view illustrating how a liquid, either the wax emulsion or the resin binder, is distributed to the outer periphery, i.e. the rim, of the rotating, slightly conical, disc, for departure in a spray of droplets enroute to dispersion on the surfaces of the particles.

In FIG. 12 distribution of liquid resin binder R to a spinning disc 52 is shown. This liquid is directed through conduits 85 and 89, then caused to change direction into stub tubes 94, 95 and discharged into a first shallow toroidal supply pool 96. After reaching a preset level, the liquid is longitudinally drained into a larger shallow toroidal pool 97 via a series of annular holes 98 in a dividing partial bulkhead, flange, or annular orifice ring 99. Thereafter in an adhering outwardly flow path 100, the liquid moves to the rim 101 of the spinning disc 52. The flow of liquid in path 100 uniformly extends throughout the circular conical surface area of the disc 52 to eventually continuously depart in a spray of droplets 29. The perimeter speed of disc 52 is about fourteen thousand feet a minute for a disc 20 inches in diameter. Circular plate 103 secured by fasterners 104 shields the flow path 100 of liquid from wind and dust. Fasteners 105 secure the disc assembly 106 to the tubular shaft 91. Fasteners 107 secure the disc to the disc assembly 106.

Though six spinning discs are illustrated in FIG. 5, it is feasible to use as few as two or up to twelve depending on the capacity requirements. The effective spray travel, as indicated in FIG. 2 is governed by the size of the droplet and disc speed. At a constant G factor, for example, of 2000, the spray torus diameter is changed relatively little in size, whether the disc is ten inches or twenty inches in diameter.

Information Concerning the Design Considerations in Respect to a Selected Shaft on Which the Spinning Discs are Mounted The natural resonant frequency of a long, rotating shaft determines limits on shaft size, speed and span between bearings. The applicable formula for this embodiment is:

$$N=69\sqrt{EI/WL^3}$$

Where:

N=natural frequency in cycles per second

E=shaft modulus of elasticity: for steel—29,000,000 psi

I=moment of inertia of shaft (Inch$^4$)

W=total weight between bearings (Lbs)

L=span between bearings (inches)

For a 12 inch steel shaft with 0.50 wall thickness with a span of 18 ft. between bearings carrying six twenty inch diameter discs the natural frequency speed is about 3,500 RPM. To attain 2,000 times gravity force at disc rim requires about 2,650 RPM. This operating speed provides a wide safety margin below critical resonant speed.

I claim:

1. A blender used to efficiently apply finely dispersed liquid droplets of resins and/or waxes spaced throughout surfaces of particles of wood materials, comprising:

(a) a hollow drum to be rotatably supported on a frame and having its interior surfaces arranged in adjacent sections which are adjustable to create different interior surface speeds to compensate for changing cohesive and frictional properties of the particles of wood materials, as they progress through the hollow drum going through multiple lift and free fall cycles said free fall being effected solely by gravitational forces;

(b) an adjustable frame to rotatably support the hollow drum at selective angles from a horizontal position to angles from a horizontal axis;

(c) a receiving assembly for particles of wood material at one end of the rotatable hollow drum;

(d) a discharging assembly for particles of wood materials at the other other end of the rotatable hollow drum;

(e) a large diameter rotatable hollow shaft positioned longitudinally within the rotatable hollow drum throughout an upper transverse quadrant of the hollow drum;

(f) spray discs spaced and mounted on the hollow longitudinal shaft to rotate with the hollow shaft, each spray disc to receive a respective liquid on a respective side, and each spray disc having a respective spaced shield to protect the liquid on the respective side of each spray disc from wind and dust prior to the liquid leaving the respective spray disc in dispersed droplets;

(g) liquid supply assemblies to deliver liquid resins and/or waxes through the rotatable hollow shaft to the respective spray discs;

(h) a power assembly to rotate the hollow shaft at selective optimum speeds;

(i) a variable speed drive assembly to rotate the hollow drum at selectable optimum speeds to produce side by side free falling cascades of particles of wood materials intermediate between spray discs and downwardly moving inner walls of the hollow drum throughout the adjacent sections along the interior of the hollow drum, and to produce side by side returning lifts of particles of wood on the moving inner hollow drum surfaces, whereby the finely dispersed liquid droplets essentially always first reach the surfaces of the particles of wood materials and do not directly reach the inner surfaces of the rotating drum.

2. A blender, as claimed in claim 1, wherein the hollow drum is rotatable in one direction, and the hollow shaft is rotatable in the other direction.

3. A blender, as claimed in claims 1 or 2, wherein each spray disc is slightly dished.

4. A blender used to efficiently and uniformly apply finely dispersed liquid droplets upon the surfaces of particulate materials comprising:

(a) a hollow drum rotatably supported on a frame to rotate essentially about a horizontal axis to provide an upwardly moving inner wall and a downwardly moving inner wall;

(b) a particulate material receiving assembly at one end of the rotatable hollow drum;

(c) a particulate material discharging assembly at the other end of the rotatable hollow drum;

(d) a high-speed rotating spray assembly means for producing a circular spray of small droplets which travel outwardly therefrom toward the outer periphery of the drum and is disposed within the upper quadrant of the drum which quadrant including the upper portion of the upwardly moving inner drum wall;

(e) power drive assembly means for rotating the hollow drum at a speed which produces a relatively uniform thin layer of lifted particulate material along the upwardly moving drum wall and a free-falling cascade of particulate material which separates due solely to gravitational forces from the drum wall shortly before reaching the uppermost point and falls to the bottom of the drum again to be lifted for subsequent free-falls until discharged from the drum;

(f) the free-falling cascade forming a curtain which is disposed between the rotating spray assembly and the downwardly moving inner wall of the hollow drum for intercepting the droplets and completing formation of a closed hollow zone substantially free of particles within the central part of the drum and within which the rotating spray assembly is substantially centrally located; and, (g) a power drive assembly connected to the high-speed rotating spray assembly means for producing rotating thereof at a selected speed which will produce an outwardly moving spray of small droplets which will impinge on and coat the particulate material.

5. The blender as set forth in claim 4, wherein the diameter of the drum is dependent upon droplet travel velocity produced by the spray assembly and the distance of the inner wall of the hollow drum being from 50 to 130 centimeters from the periphery of the spray assembly.

6. The blender as set forth in claim 5, wherein: the diameter of the drum can vary from 4 to 10 feet.

7. The blender as set forth in claim 4, wherein: the spray assembly means includes at least one rotating circular spray disc which is mounted on a supporting hollow shaft which extends axially into the drum and through which spray material is supplied.

8. The blender as set forth in claim 7, wherein: the diameter of the drum is dependent upon the droplet travel distance from the spray assembly, and droplet size and travel distance is governed by spray assembly perimeter centrifugal force which is within the range of approximately 2,000 force.

9. The blender as set forth in claim 7, wherein: the periphery of the disc is from 50 to 130 centimeters and the diameter of the disc is from 4 to 30 inches.

10. The blender as set forth in claim 4, wherein: the drum diameter is progressively reduced from the feed input depending upon cohesion behavior of the treated material as it moves progressively from the large diameter end of the drum to the smaller diameter output of the drum.

11. The blender as set forth in claim 4, wherein: the drum is rotatably supported on a frame and has its interior surfaces arranged in adjacent contiguous independently revolvable sections which are individually adjustable to create successively different interior surface speeds between adjacent sections to compensate for change in cohesive and frictional properties of the particulate material as it progresses through the drum in multiple lift and free-fall cycles.

12. A blender as claimed in claims 4 or 7, wherein: a liquid supply assembly supplies two different liquids to the rotating spray assembly means, the spray means including two axially spaced spray discs to one of which one liquid is supplied and to the other of which the other liquid is supplied.

13. A blender, as claimed in claim 4 comprising in addition an adjustable frame to rotatably support the hollow drum at selective angles from a horizontal axis.

14. A blender, as claimed in claim 4, comprising spaced additional high-speed rotating spray assembly means.

15. A blender, as claimed in claim 14, wherein a liquid supply assembly delivers liquid to all the high-speed rotating spray assembly means.

16. A blender, as claimed in claim 4, wherein the hollow drum is tapered from a larger insider diameter where the particulate materials are received to a smaller inside diameter where the particulate materials are discharged, to compensate for changing cohesive and friction properties of the particulate materials as they progress through the hollow drum going through multiple lift and free-fall cycles.

17. A blender, as claimed in claims 7 or 12, wherein the power drive assembly to rotate the hollow drum rotates in one direction, and the power drive assembly to operate the hollow shaft rotates in the other direction.

18. A blender, as claimed in claims 7 or 12, wherein shields are mounted adjacent to the sides of each disc sprayer to protect the respective liquid films from wind and dust prior to their controller size droplet departure from the disc sprayers.

* * * * *